US008813273B2

(12) United States Patent
Stimpson

(10) Patent No.: US 8,813,273 B2
(45) Date of Patent: Aug. 26, 2014

(54) WASTE WATER OUTLET UNIT

(75) Inventor: Robert William Stimpson, Douglas (IM)

(73) Assignee: DLP Limited, Braddan (IM)

( * ) Notice: Subject to any disclaimer, the term of this patent is extended or adjusted under 35 U.S.C. 154(b) by 1753 days.

(21) Appl. No.: 11/721,806

(22) PCT Filed: Sep. 7, 2005

(86) PCT No.: PCT/GB2005/003442

§ 371 (c)(1),
(2), (4) Date: Sep. 24, 2009

(87) PCT Pub. No.: WO2006/030180

PCT Pub. Date: Mar. 23, 2006

(65) Prior Publication Data

US 2010/0024107 A1 Feb. 4, 2010

(30) Foreign Application Priority Data

Sep. 17, 2004 (GB) ..... 0420691.8

(51) Int. Cl.

| | |
|---|---|
| ***E03C 1/26*** | (2006.01) |
| ***A47K 1/14*** | (2006.01) |
| ***E03C 1/12*** | (2006.01) |
| ***A47K 3/00*** | (2006.01) |
| ***E03F 5/06*** | (2006.01) |
| ***E03C 1/22*** | (2006.01) |

(52) U.S. Cl.

CPC ..... *E03C 1/22* (2013.01)
USPC ..... 4/288; 4/287; 4/293; 4/679; 4/613; 210/163

(58) Field of Classification Search

USPC ..... 4/293, 286–291, 612–613; 285/910, 42, 285/901, 360; 403/348, 349; 210/163
See application file for complete search history.

(56) References Cited

U.S. PATENT DOCUMENTS

| | | | | | |
|---|---|---|---|---|---|
| 4,463,461 | A | * | 8/1984 | van den Broeke et al. | 4/288 |
| 4,948,096 | A | * | 8/1990 | Alderman | 251/357 |
| 5,067,751 | A | * | 11/1991 | Walworth et al. | 285/105 |
| 5,145,276 | A | * | 9/1992 | Demange | 403/349 |
| 5,704,659 | A | * | 1/1998 | Lunder | 285/361 |
| 5,938,055 | A | * | 8/1999 | Philips et al. | 215/222 |
| 6,152,494 | A | * | 11/2000 | Corbett et al. | 285/110 |
| 6,418,569 | B1 | | 7/2002 | Knight | |

(Continued)

FOREIGN PATENT DOCUMENTS

| | | |
|---|---|---|
| DE | 9102152 U | 5/1991 |
| DE | 19901555 | 7/2000 |

(Continued)

OTHER PUBLICATIONS

English abstract and English translation of JP 08158439 A.*

(Continued)

*Primary Examiner* — Huyen Le
*Assistant Examiner* — Christine Skubinna
(74) *Attorney, Agent, or Firm* — Eitan, Mehulal & Sadot

(57) ABSTRACT

A waste outlet unit cover for a waste water outlet unit for a shower tray, the cover comprising a non-screw threaded attachment arrangement by which the cover can be securely and releasably attached to the waste water outlet unit. A waste water outlet unit having such a cover is also provided.

15 Claims, 12 Drawing Sheets

(56) References Cited

U.S. PATENT DOCUMENTS

| | | | | |
|---|---|---|---|---|
| 6,890,427 | B2 * | 5/2005 | Self et al. | 210/163 |
| D557,771 | S * | 12/2007 | Darce | D23/269 |
| 2005/0092945 | A1 * | 5/2005 | Heller et al. | 251/30.01 |

FOREIGN PATENT DOCUMENTS

| | | | |
|---|---|---|---|
| DE | 19951696 | | 5/2001 |
| DE | 10210496 | | 4/2003 |
| EP | 0198385 | | 10/1986 |
| EP | 0816580 | A2 | 1/1998 |
| GB | 2 334 885 | | 9/1999 |
| GB | 2 373 182 | | 9/2002 |
| GB | 2 378 648 | | 2/2003 |
| GB | 2 406 270 | | 3/2005 |
| GB | 2 418 355 | | 3/2006 |
| JP | 08158439 | | 6/1996 |
| JP | 08158439 | A * | 6/1996 |
| WO | WO 2004/049881 | | 6/2004 |
| WO | WO 2006/030180 | | 3/2006 |

OTHER PUBLICATIONS

International Search Report for PCT/GB2005/003442 mailed on Feb. 22, 2006.

European Search Report for corresponding European application EP08009961 mailed on Dec. 17, 2009.

Computerized English Translation of the text of DE 9102152U, generated on Mar. 21, 2013.

Espacenet, Bibliographic Data and English Abstract of EP 0816580 A2, printed from the Internet on Mar. 21, 2013.

* cited by examiner

WASTE WATER OUTLET UNIT

RELATED APPLICATIONS

This application is a National Phase Application of PCT International Application Number PCT/GB2005/003442, International Filing Date Sep. 7, 2005, published on Mar. 23, 2006 as International Application Publication Number WO 20061030180, which in turn claims priority of Great Britain Patent Application Number GB 0420691.8, filed on Sep. 17, 2004, both of which are incorporated herein by reference in their entirety.

FIELD OF THE INVENTION

The present invention relates to a waste water outlet unit for a shower tray, and more particularly to a cover for such a unit, to dip tube and bucket for such a unit, and to a sealing device for an outlet of such a unit.

BACKGROUND OF THE INVENTION

Cleaning of a waste water outlet unit for a shower tray is extremely important. It is presently troublesome to fully access the interior and the internally located parts of known units.

Furthermore, once the shower tray has been installed, it is extremely difficult to repair leaking connections between the waste water outlet unit and the discharge pipe or pipes.

The present invention seeks to provide solutions to these problems.

BRIEF SUMMARY OF THE INVENTION

According to a first aspect of the invention, there is provided a waste water outlet unit cover for a waste water outlet unit for a shower tray, the cover comprising a non-screw threaded attachment arrangement by which the cover can be securely and releasably attached to the waste water outlet unit.

Preferable and/or optional features of the first aspect of the invention are set forth in claims 2 to 13.

According to a second aspect of the invention, there is provided a dip tube and bucket combination for a waste water outlet unit for a shower tray, the dip tube being snap-fit releasably engageable with the bucket.

Preferable and/or optional features of the second aspect of the invention are set forth in claims 15 to 24.

According to a third aspect of the invention, there is provided a waste water outlet unit for a shower tray having a drain opening, the unit comprising a trap body having a waste water inlet at its upper end and a waste water outlet, and a releasable dip tube positioned within or substantially within the trap body, the dip tube being extractable from the trap body for cleaning.

Preferable and/or optional features of the third aspect of the invention are set forth in claims 25 to 27.

According to a fourth aspect of the invention, there is provided a flexible sealing device for an outlet of a waste water outlet unit, the sealing device having a continuous ring shape with a frusto conical or substantially frusto conical bore.

Preferable and/or optional features of the fourth aspect of the invention are set forth in claims 29 to 35.

BRIEF DESCRIPTION OF THE DRAWINGS

The invention will now be more particularly described, by way of example only, with reference to the accompanying drawings, in which.

DETAILED DESCRIPTION OF THE INVENTION

Figure 1:
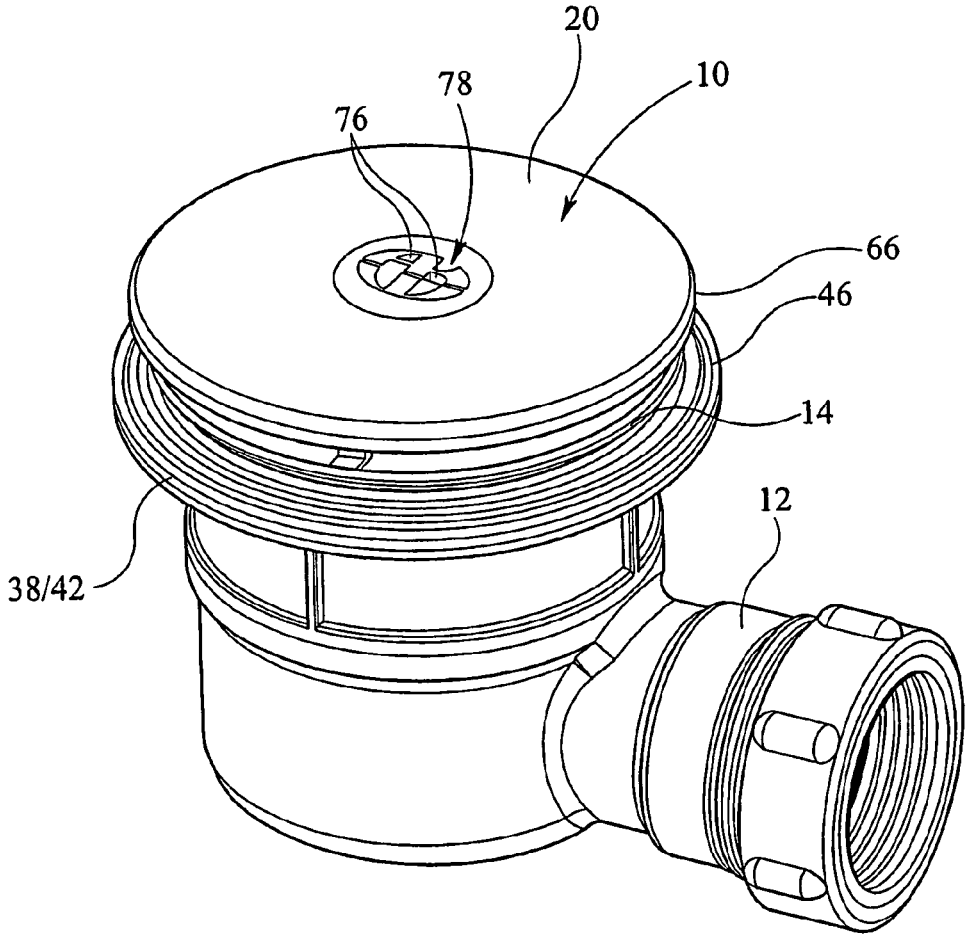
FIG. 1 is a perspective view of one embodiment of an assembled waste water outlet unit, in accordance with the invention.

Referring to the drawings, there is shown a waste water outlet unit 10 which comprises a base element 12, a clamp element 14, a dip tube 16, a bucket 18, and a cover 20, all of which are typically made from plastics material.

Figure 2:
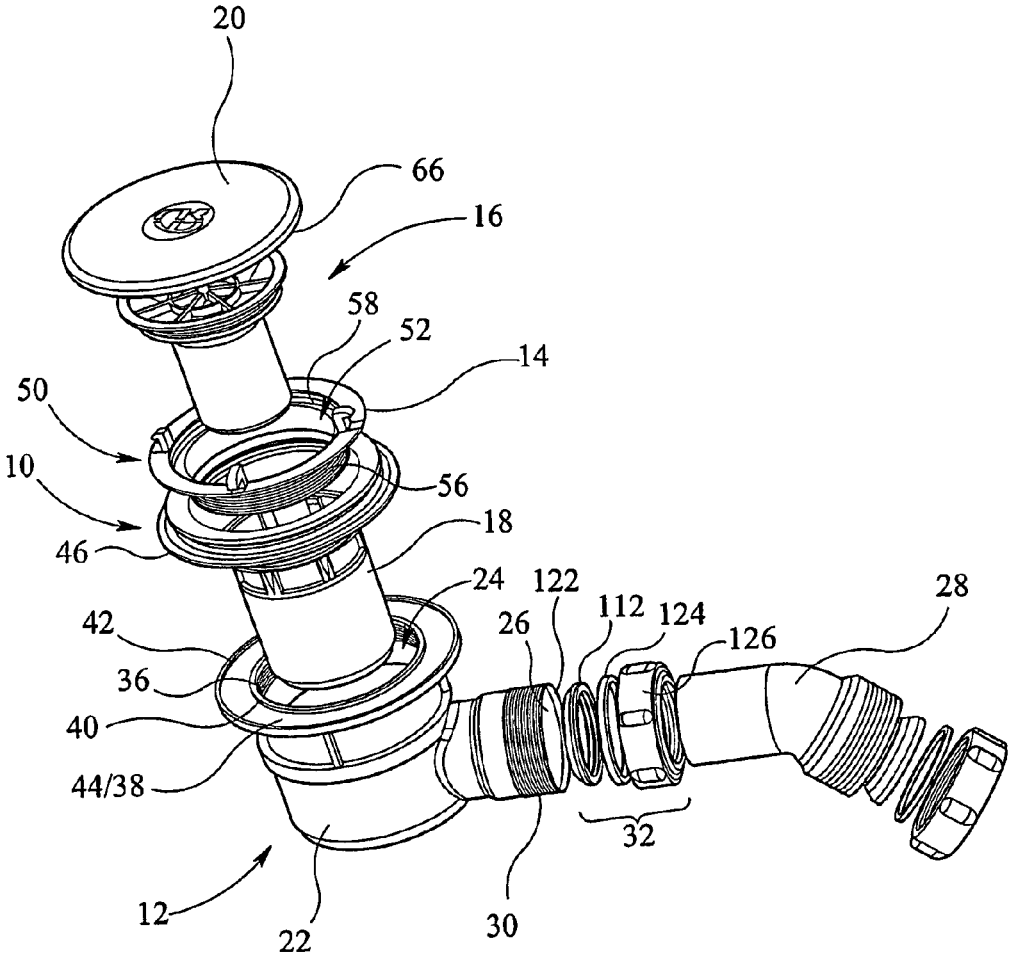
FIG. 2 is an exploded view of the waste water outlet unit shown in FIG. 1.

The base element 12 is in the form of a cylindrical or substantially cylindrical hollow trap body 22 having a waste water inlet 24 and a waste water outlet 26 in or adjacent to its underside. The waste water outlet 26 is adapted to be connectable to a standard diameter waste water discharge pipe 28, and as such includes a threaded outlet portion 30 which can accept a pipe connector 32, as shown in FIG. 2.

The interior surface 34 of the base element 12 is formed with a screw-thread 36 which extends from the waste water inlet 24.

The base element 12 also includes an outwardly projecting base flange 38 which is formed on the trap body 22 at a position spaced slightly from the edge of the waste water inlet 24 so that a spigot 40, which upstands from the base flange 38 is created.

The base flange 38 includes a peripheral upturned edge 42 and this, in conjunction with the exterior surface of the spigot 40, forms a recessed seating 44 in which a, typically rubber, base gasket 46 is positioned. The base gasket 46 is dimensioned to be received as a tight fit over the spigot 40, and the upper surface includes a plurality of planar or substantially planar concentric ridges 48, the reason for which will become apparent hereinafter.

The clamp element 14 comprises a clamp body 50 having a clamp aperture 52 coaxially formed therethrough, and an outwardly projecting clamp flange 54 formed on the upper edge of the clamp body 50.

An external screw-thread 56, which is adapted to mate with the internal screw-thread 36 of the base element 12, extends from the bottom edge of the clamp body 50, and the inwardly facing edge of the clamp flange 54 is recessed relative to the internal surface of the clamp body 50 to form a shoulder portion 58 on which the dip tube 16 can be seated.

A cover retaining arrangement is included as part of the clamp element 14. The retaining arrangement is the form of a plurality of upstanding cover support members 60, being in this case four, formed on the upper surface of the clamp flange 54. Each cover support member 60 includes a head 62 formed at its distal end which projects radially outwards to form an overhang.

Figure 3:
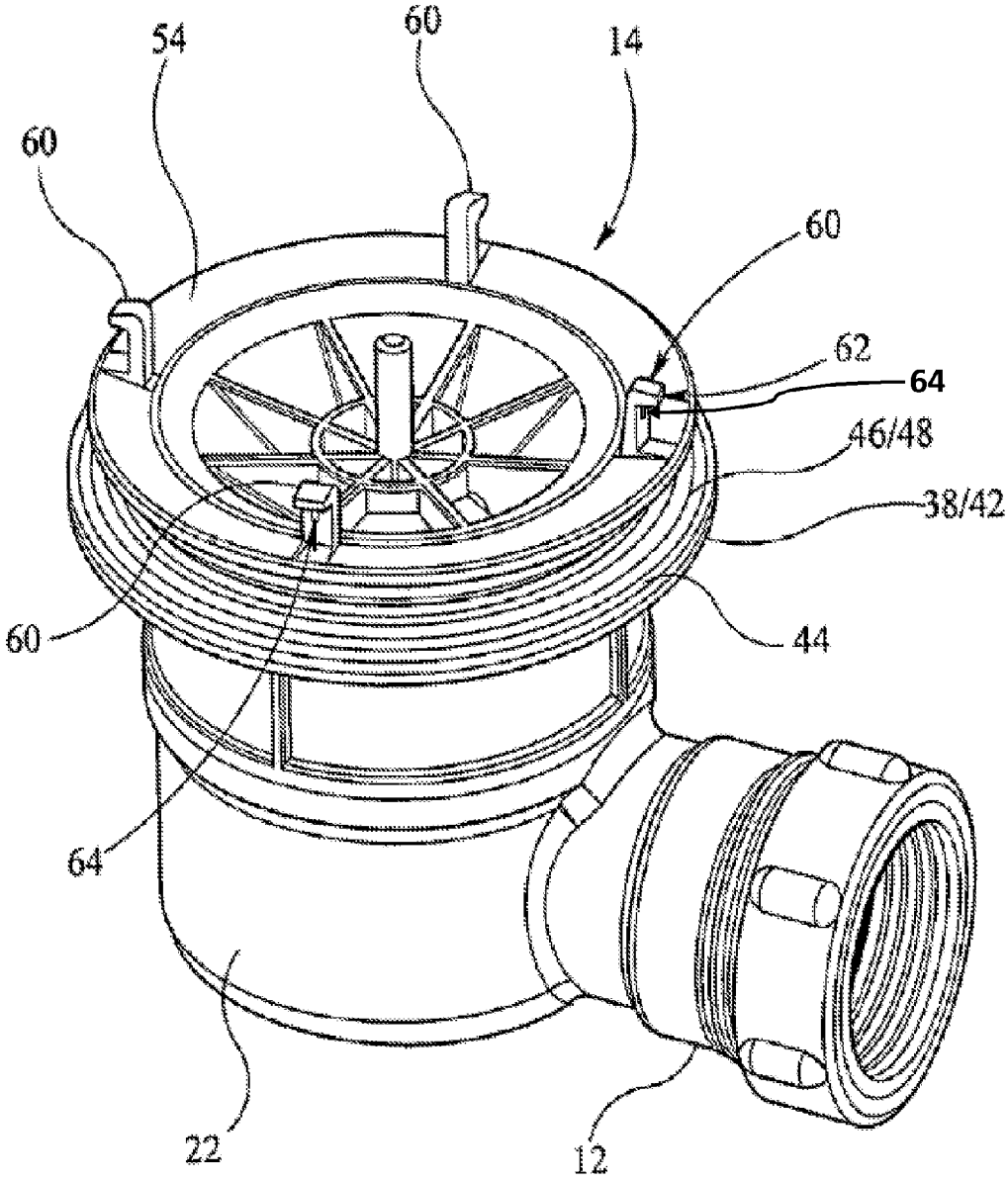
FIG. 3 is a perspective view of the waste water outlet unit with cover removed.
Figure 4A:
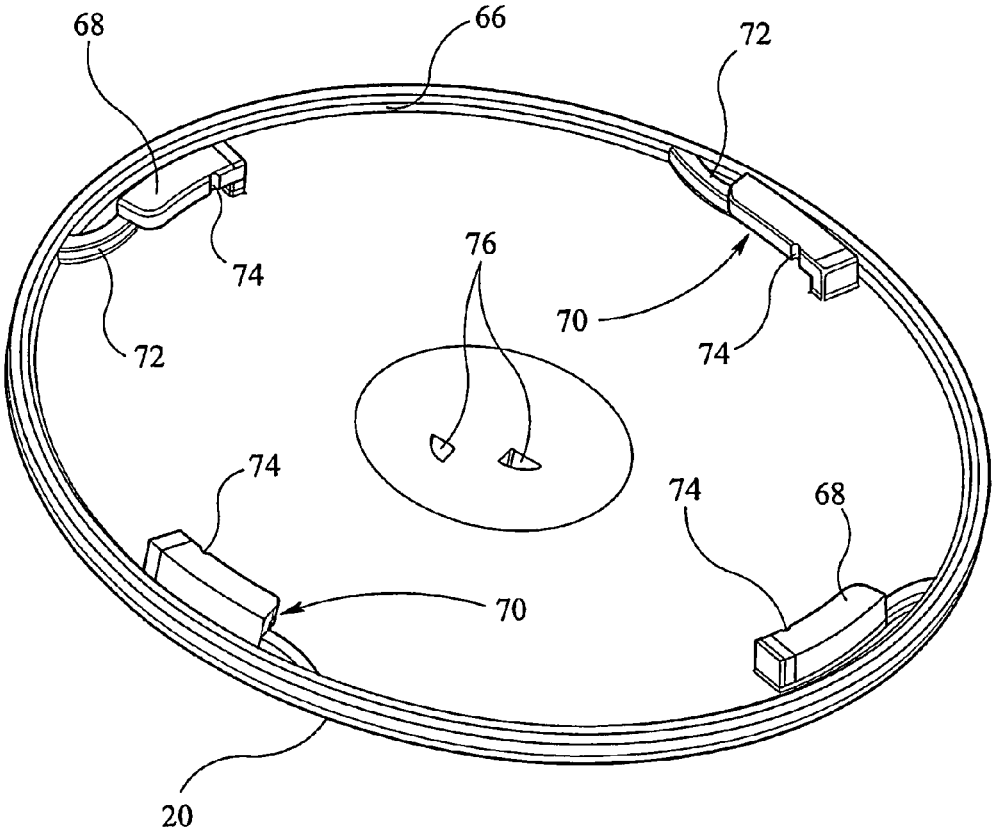
FIG. 4*a* is a perspective view of the underside of the cover.
Figure 4B:
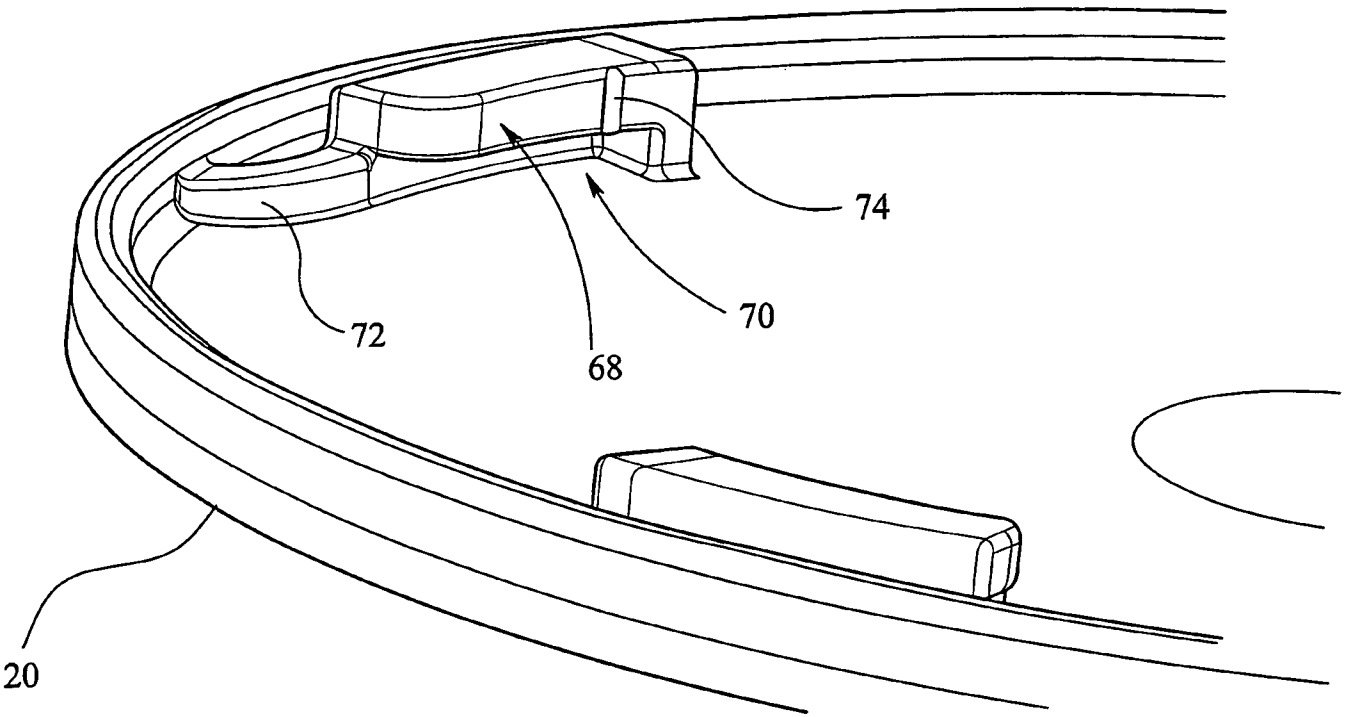
FIG. 4*b* is an enlarged view of part of the underside of the cover.
Figure 5:
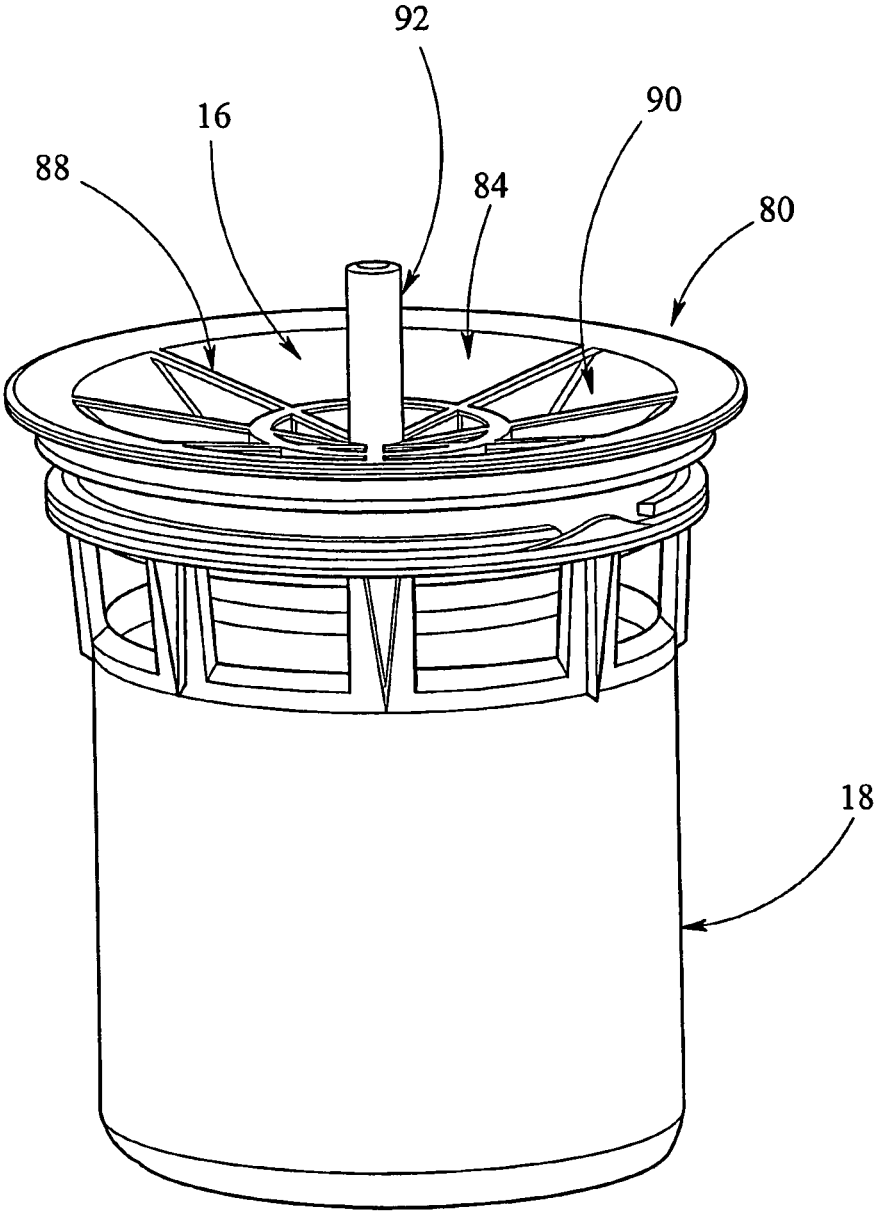
FIG. 5 is a perspective view of a dip tube and bucket, when removed from a trap body of the waste water outlet unit.
Figure 6:
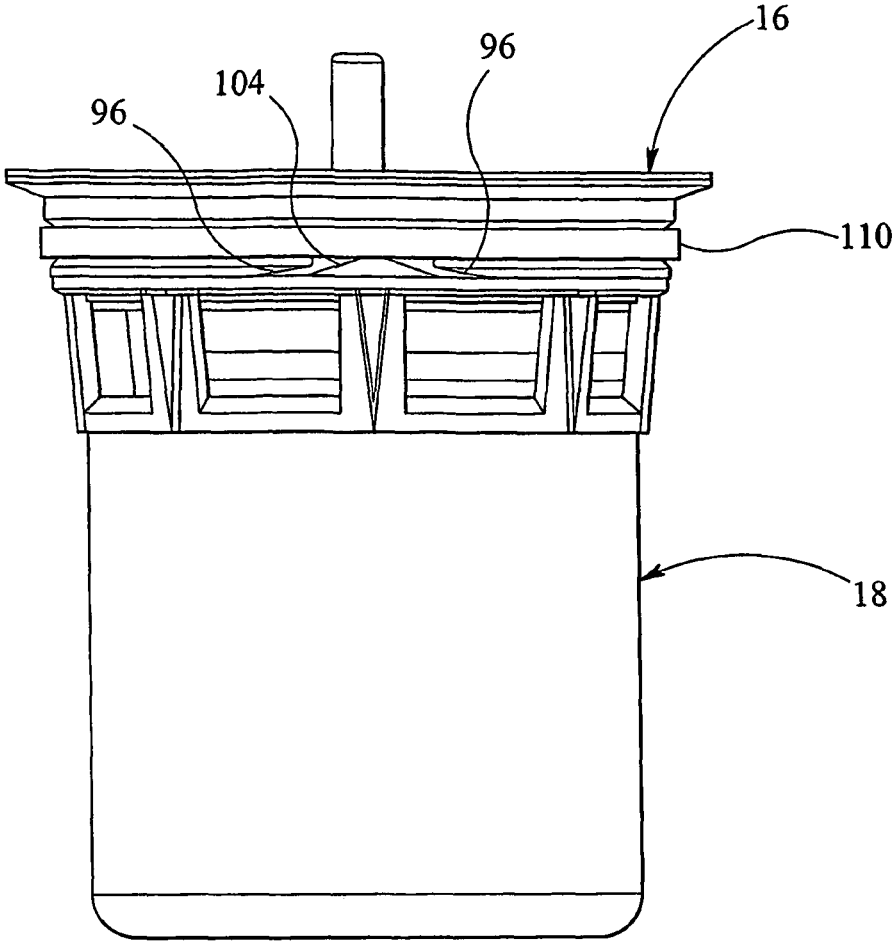
FIG. 6 is a side view of the dip tube and bucket.
Figure 7:
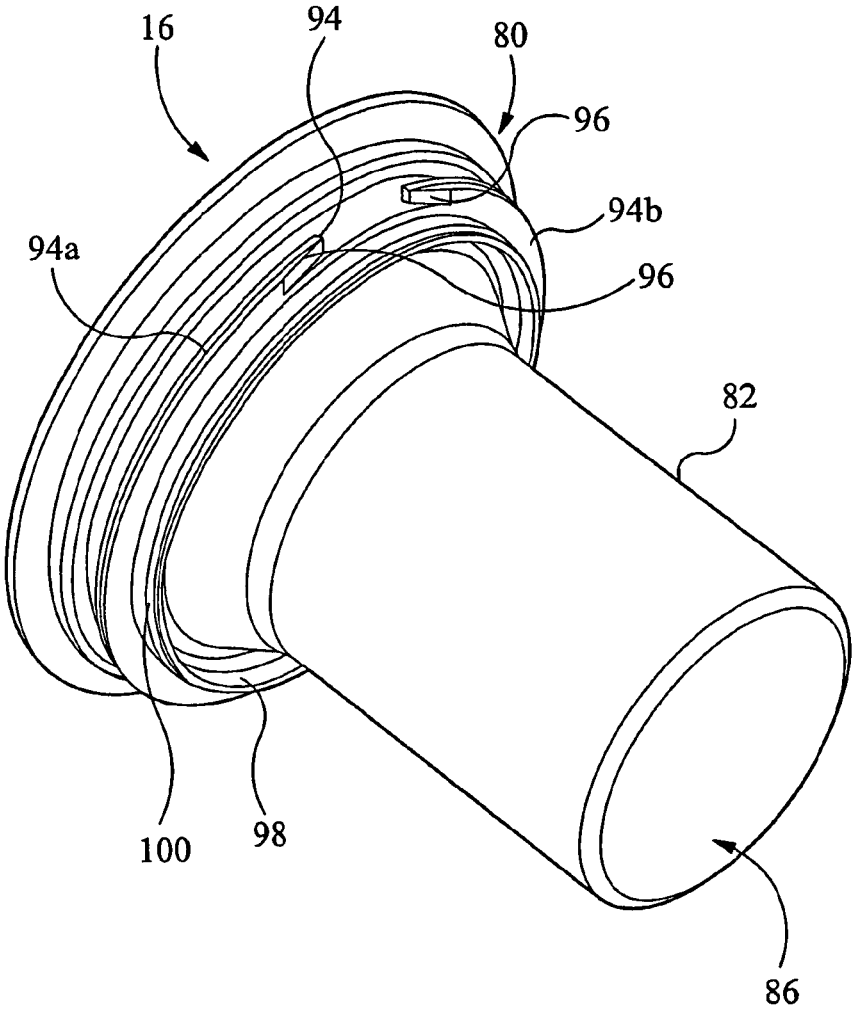
FIG. 7 is a perspective view of the dip tube.
Figure 8:
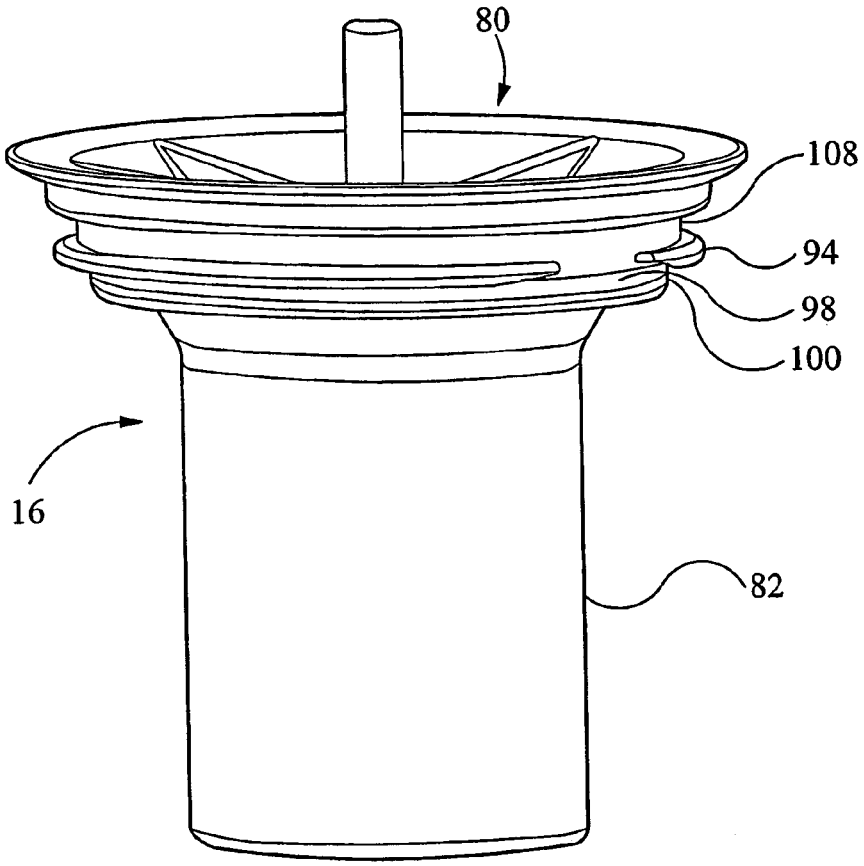
FIG. 8 is another perspective view of the dip tube.
Figure 9:
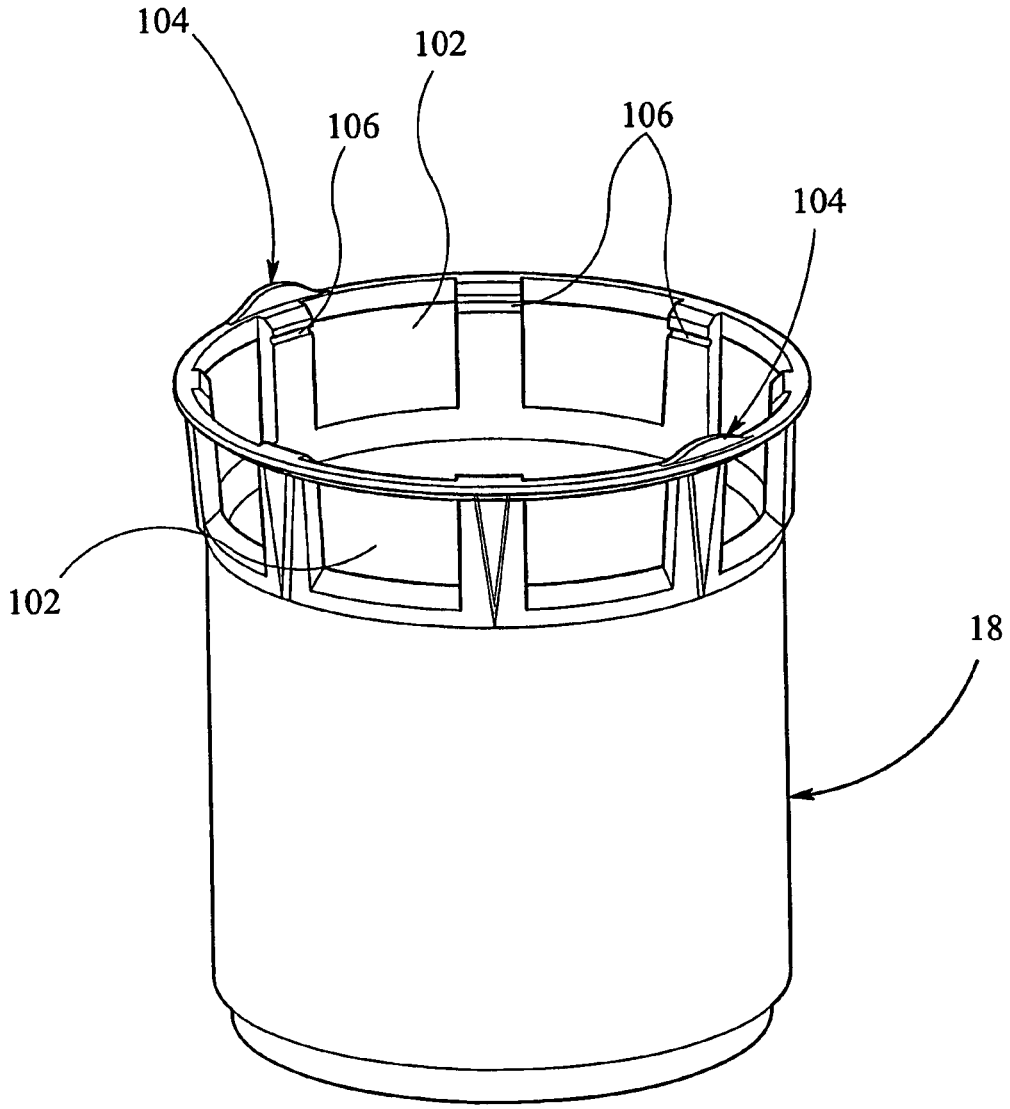
FIG. 9 is a perspective view of the bucket.

A retaining ridge 64 is formed directly beneath the overhang. See FIG. 3. As demonstrated in FIG. 3 and in FIG. 4*b*, each retaining ridge 64 extends parallel to a longitudinal axis of its associated cover support member 60.

The cover 20 includes a slight skirt 66 around its circumference, and the cover 20 is of sufficient size to extend over the clamp element 14 and beyond the peripheral edge of the clamp flange 54. A plurality of lips 68 is formed, typically by moulding, on the underside of the cover 20 adjacent to the skirt 66. The lips 68 project radially inwards and form part of a non-screw-threaded attachment arrangement of the cover 20. The lips 68 thus produce recesses 70 for receiving the overhanging heads 62 of the cover support members 60.

To guide the overhanging heads 62 of the cover support members 60 into the head recesses 70 formed by the lips 68, cam surfaces 72 are provided. The cam surfaces 72 form a further part of the non-screw threaded attachment arrangement and are provided at a position whereby the cover support members 60 are flexed slightly radially inwardly as the respective heads 62 ride up the cam surfaces 72 and into the recesses 70. This promotes secure engagement of the cover 20 with the clamp element 14.

To positively engage the cover 20 with the cover support members 60, the radial inner edge of each lip 68 is formed with a retaining recess 74 which is complementarily shaped to receive the retaining ridge 64 located beneath the overhanging head 62 of each cover support member 60. As the cover 20 is twisted into engagement with the cover support members 60, each head 62 travels along a respective cam surface 72, into one of the head recesses 70 formed by the lips 68, until the retaining ridge 64 seats in the retaining recess 74.

The cover 20 also includes one or more vent apertures 76, in this case two, formed in a stamped logo 78. The vent apertures 76 prevent the possibility of an airlock forming in the unit 10 as water drains.

Referring to FIGS. 5 to 10, the dip tube 16 and bucket 18 are shown. The dip tube 16 and bucket 18 are releasably engaged with each other to allow them to be withdrawn from the trap body 22 as a single entity. The dip tube 16 has a head 80 and elongate body 82 which is cylindrical. A water inlet 84 is formed in the head 80, which is positionable adjacent the clamp element 14. A water outlet 86 is formed at the end of the elongate body 82 and is spaced from the bottom of the bucket 18, when the dip tube 16 and bucket 18 are engaged.

The water inlet 84 of the dip tube 16 is formed with a filter element 88, which has a plurality of filter apertures 90. The filter element 88 acts to catch hair and other debris which allowing draining water to pass into the dip tube 16.

An upstanding elongate peg element 92 is formed centrally or substantially centrally on the filter element 88. The peg element 92 prevents removal or displacement of the dip tube 16, and thus also the bucket 18, when the cover 20 is fully fastened to the cover support members 60. As such, in this condition, the free end of the peg element 92 abuts or very nearly abuts the bottom surface of the cover 20.

The peg element 92 also acts as a finger grip by which the dip tube 16 and connected bucket 18 can be grasped and withdrawn from the trap body 22.

The dip tube 16 includes a non-continuous flange 94 formed on the head 80. At the ends of each part of the flange 94, a ramp portion 96 is provided. In this embodiment, the flange 94 is formed in two spaced parts 94*a*,94*b*. However, the flange 94 could be formed in more than two parts, or could be a single non-continuous flange 94, or could even be a continuous flange with ramped recesses.

Spaced from the non-continuous flange 94 and towards the elongate body 82, the head 80 of the dip tube 16 includes a depending skirt 98 on the exterior surface of which is formed an engaging ridge 100. Preferably, the engaging ridge 100 is continuous, but it may be non-continuous.

The bucket 18 is formed with weir apertures 102 adjacent an upper edge thereof. Two ramped projections 104 are formed upstanding from the upper edge of the bucket 18, and dip tube engaging recesses 106 are formed in equiangularly spaced relationship around the interior of the bucket 18 adjacent to the upper edge. The engaging ridge 100 of the dip tube 16 and the engaging recesses 106 of the bucket 18 are complementarily shaped.

To engage the dip tube 16 and the bucket 18, the dip tube 16 is slid into the interior of the bucket 18. The ramped projections 104 of the bucket 18 are located between the ramp portions 96 of the flange 94 of the dip tube 16, and the engaging ridge 100 of the dip tube 16 is snap fit inserted into the engaging recesses 106 of the bucket 18. The head 80 of the dip tube 16 is a reasonably tight fit with the bucket 18 to inhibit water flow between the skirt 98 of the head 80 of the dip tube 16 and the upper edge of the bucket 18.

To release the dip tube 16 from the bucket 18, the head 80 of the dip tube 16 is simply grasped and twisted relative to the bucket 18. This twisting action causes the N ramped projections 104 of the bucket 18 to ride up the corresponding ramp portions 96 of the flange 94 of the dip tube 16, thus resulting in axial displacement of the dip tube 16 relative to the bucket 18. This axial displacement results in the engaging ridge 100 of the dip tube 16 disengaging from the engaging recesses 106 of the bucket 18, and the dip tube 16 can thus be withdrawn from the bucket 18.

The dip tube 16 and bucket 18, when interconnected, are located primarily in the trap body 22 of the waste water outlet unit 10. The head 80 of the dip tube 16 is seated on the shoulder portion 58 of the clamp flange 54, and the bucket 18 is suspended from the dip tube 16.

A channel 108 is provided on the head 80 of the dip tube 16, adjacent the flange 94. The channel 108 is adapted to accept an O-ring type seal 110 (see FIG. 10) which produces a liquid tight seal between the dip tube 16 and the bore of the clamp body 50.

Figure 11:
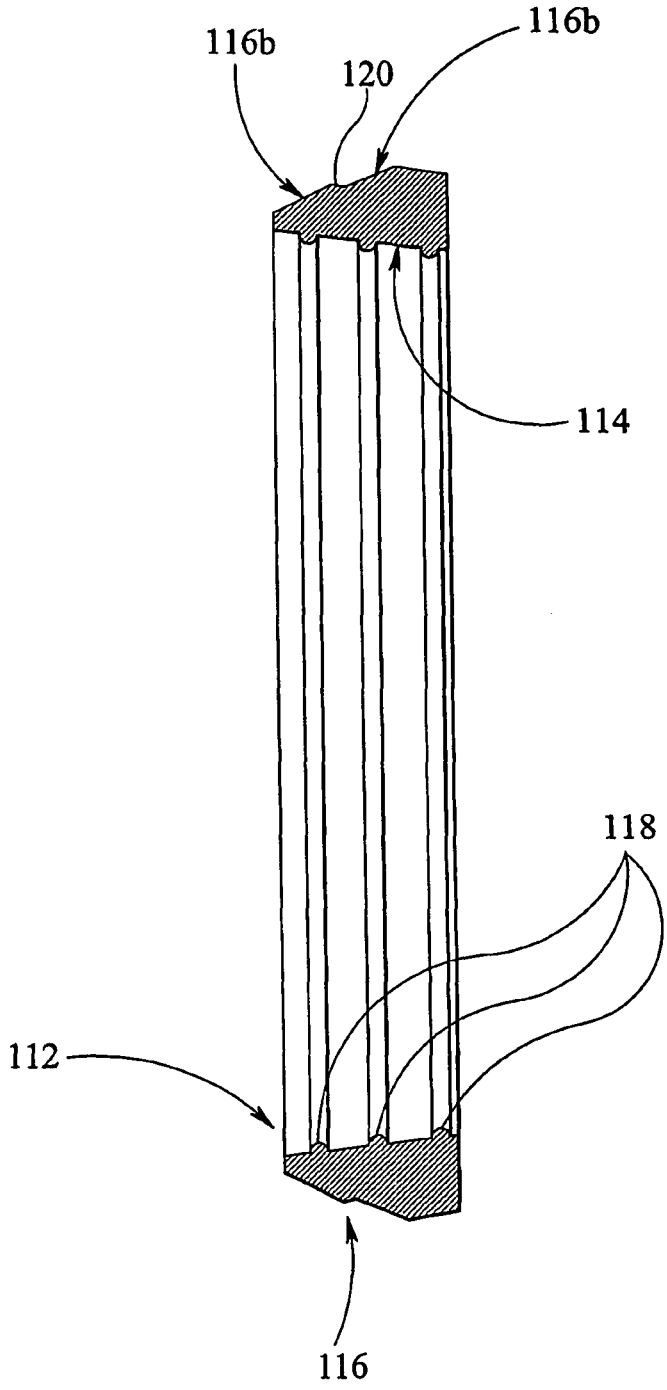
FIG. 11 is a cross-sectional view of a sealing device shown in FIG. 2.

In use, the waste water outlet 26 of the trap body 22 is typically first connected to a waste water discharge pipe 28, as in FIG. 2. To promote a resilient and long lasting liquid tight connection between the waste water outlet 26 and the discharge pipe 28, a sealing device 112 is provided, as best shown in FIG. 11. The sealing device 112 is a flexible, typically rubber or plastics, sealing ring. The ring is continuous, and comprises a frusto-conical bore 114. At least part of the exterior surface of the sealing device 112 is also frusto-conical.

The frusto-conical bore 114 tapers in a first direction, and the frusto-conical part 116 of the exterior surface taper in a second direction which is opposite the first direction. As such, the bore 114 and the exterior surface, if extended, would converge.

A plurality of sealing ribs 118 is provided in spaced relationship axially along the bore 114 of the sealing device 112. The ribs 118 are continuous and project radially inwards by the same or substantially same amount.

The frusto-conical part 116 of the exterior surface has two frusto-conical portions 116*a*, 116*b* of differing taper. An exterior ridge 120 is thus produced between the two frusto-conical portions 116*a*, 116*b*. The angle of taper of the frusto-conical portion 116*a* at the generally converging end of the sealing device 112 is less acute than the angle of taper of the other frusto-conical portion 116*b*.

The sealing device 112 is slid onto the end of the discharge pipe 28. This fit is tight due to at least one of the sealing ribs 118. The generally converging end of the sealing device 112 seats on a chamfered edge 122 of the bore of the waste outlet 26 of the waste water outlet unit 10. A backing ring 124 is slid to abut the end of the sealing device 112 which is opposite the generally converging end, and a locking nut 126 is screw-threadingly engaged with the waste outlet 26. As the locking nut 126 is tightened, the backing ring 124 urges the sealing device 112 along the chamfered edge 122 of the waste outlet 26, thereby reducing the internal diameter of the sealing device 112 and causing further ribs 118 to seal against the circumference of the discharge pipe 28.

As the locking nut 126 is tightened, the exterior ridge 120 of the sealing device 112 also promotes the formation of one or more local ridges which seal against the chamfered edge 122 of the waste outlet 26. The trailing frusto-conical portion 116*b*, due to the more acute angle of taper, completes the fluid-tight seal.

In addition to providing a good compression fit seal between the waste water outlet unit 10 and a discharge pipe 28, the sealing device 112 can be utilised between pipes 28, as shown in FIG. 2.

The waste water outlet unit 10 is intended to be used as part of a more traditional gravity-type waste, but can be used as part of a pumped waste.

The base element 12 of the waste water outlet unit 10, positioned beneath the shower tray (not shown), has the spigot 40 located in a drain opening (not shown) of the shower tray, so that the upper surface of the base gasket 46 contacts the underside surface of the shower tray and the drain opening is completely covered.

Figure 10:
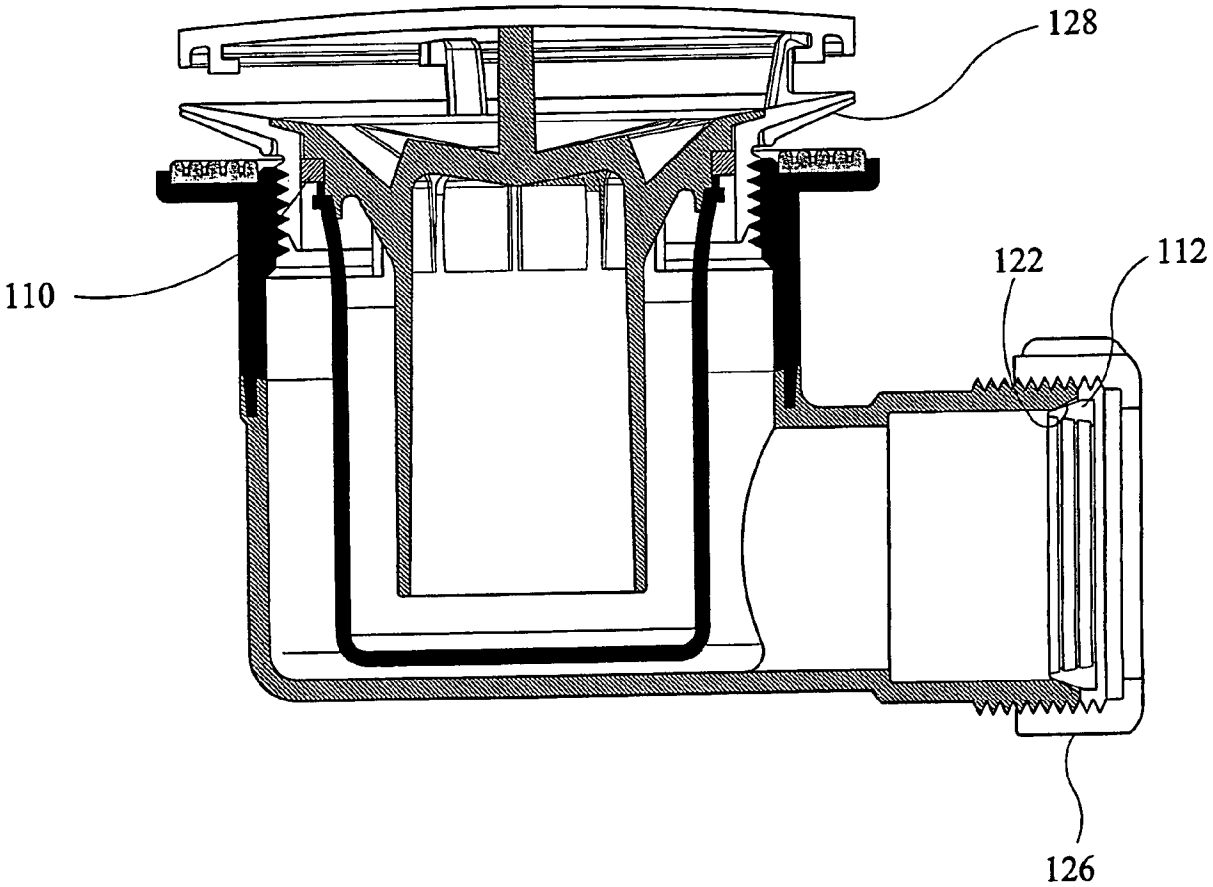
FIG. 10 is a cross-sectional view of the waste water outlet unit shown in FIG. 1.

The clamp element 14 is located on the topside of the shower tray and the external screw-thread of the clamp element 14 is engaged with the internal screw-thread of the trap body 22. As shown in FIGS. 2 and 10, the clamp element 14 also includes a clamp gasket 128 provided on the underside of the clamp flange 54. The clamp element 14 is thus tightened until the base element 12 is firmly clamped to the underside of the shower tray through the base flange 38 and the clamp flange 54.

Since shower trays are typically formed from glass reinforced plastic (GRP), the surfaces are often not particularly flat. As the clamp element 14 is tightened to the base element 12, the base gasket 46 and clamp gasket 128 deform to follow the contours of the underside surface surrounding the drain opening, and therefore provide a fluid tight seal to prevent leakage between the edge of the drain opening and the unit 10.

The dip tube 16 with O-ring seal 110 is then releasably engaged with the bucket 18, as described above, and with the peg element 92 facing upwards, both are lowered into the trap body 22 of the base element 12 until the dip tube 16 seats on the shoulder portion 58 of the clamp element 14.

The cover 20 is then twistingly engaged with the cover support members 60, again as described above, until the retaining ridges 64 snap engage with the retaining recesses 74.

The dip tube 16 and bucket 18 generate a serpentine flow path for chaining water. Waste water flows into the waste water outlet unit 10 between the cover 20 and the clamp flange 54. The waste water then flows into the dip tube 16 via the filter element 88, down the elongate body 82 and into the bucket 18. The waste water flows up the bucket 18, out through the weir apertures 102, and into the trap body 22, at which point it then flows to the waste water outlet 26 in the side wall of the trap body 22, and out along the discharge pipe 28.

When access to the interior of the waste water outlet unit 10 is requested, for example, for cleaning or maintenance, the cover 20 is released by twisting so that the heads 62 of the cover support members 60 separate from the lips 68 of the cover 20. The cover 20 is lifted away, and the dip tube 16 and bucket 18 are withdrawn from the trap body 22 via the peg element 92 of the dip tube 16. The trap body 22 can then be fully accessed without hindrance.

The dip tube 16 and bucket 18 are then twisted relative to one another to disengage. Consequently, the dip tube 16 can be fully accessed from the outlet end of the elongate body 82, and the bucket 18 can be fully accessed from its top edge.

It is envisaged that the cover with non-screw threaded attachment arrangement can be used on any type of waste water outlet unit for a shower tray, dispensing with the need for screw-threaded fasteners, providing the cover retaining arrangement is present on the waste water outlet unit.

The cover support members of the retaining arrangement need not necessarily be provided on the clamp element, provided they upstand from the waste water outlet unit and enable the cover to be releasably attached.

It is also envisaged that the dip tube and bucket combination need not necessarily be used solely in conjunction with a twistably releasable cover. Providing the cover can be released, the releasably engaged dip tube and bucket can be lifted out of the trap body.

The dip tube could also be used without the bucket. In this case, the dip tube would simply be withdrawn via the peg element for cleaning, once the cover had been removed.

It is thus possible to provide a waste water outlet unit for a shower tray having increased accessibility. It is also possible to provide a removable dip tube and bucket which can be push fit engaged with each other and twistingly separated. A flexible sealing device for an outlet of a waste water outlet unit which produces a far more positive seal is also provided.

The embodiments described above are given by way of examples only, and other modifications will be apparent to persons skilled in the art without departing from the scope of the invention as defined by the appended claims.

The invention claimed is:

1. A waste water outlet unit cover for a waste water outlet unit for a shower tray, the cover comprising a body, a skirt around the circumference of the body wherein the skirt has an unbroken exterior surface, and a non-screw threaded attachment arrangement by which the cover can be securely and releasably attached to the waste water outlet unit, the non-screw threaded attachment arrangement having a lip provided on an underside of the cover and extending radially inwardly from the skirt, thereby forming a recess defined by an underside of the body and the lip which receives a cover support member of the waste water outlet unit so that the cover is supportable by the cover support member in a raised condition;

wherein the non-screw threaded attachment arrangement of the cover further comprises a cam surface which guides the cover support member of the waste water outlet unit into the recess, for flexional engagement with the cover with a twistable engagement.

2. The cover as claimed in claim 1, wherein a plurality of said recesses are provided in spaced relationship.

3. The cover as claimed in claim 1, further comprising at least one vent aperture which prevents in use an air lock within the waste unit.

4. A waste water outlet unit for a shower tray having a drain opening, the unit comprising a cover retaining arrangement, and a cover having a non-screw threaded attachment arrangement by which the cover can be securely and releasably attached by a twist engagement with the waste water outlet unit, the cover retaining arrangement being positionable adjacent the drain opening of the shower tray and including one or more cover support members cooperable with the non-screw threaded attachment arrangement of the cover, so that the cover is releasably engagable with the cover support members whereby the cover is held in spaced relationship over the drain opening, each cover support member including a radially outwardly projecting head and a retaining ridge extended parallel to a longitudinal axis of said cover support member, wherein said cover support member is snap-engageable with a retaining recess in the cover.

5. The waste water outlet unit as claimed in claim 4, further comprising a base element which is locatable on the underside of the shower tray to cover the drain opening, and a clamp element which is locatable on the topside of the shower tray and which is engageable with the base element to clamp the base element to the underside of the shower tray, the clamp element including the cover retaining arrangement.

6. The waste water outlet unit as claimed in claim 4, wherein the radially outwardly projecting head is an overhang.

7. A waste water outlet unit for a shower tray having a drain opening, the waste water outlet unit comprising:

a trap body having: a waste water inlet at its upper end, and a waste water outlet at or adjacent to its lower end; and a dip tube and bucket combination positionable within or substantially within the trap body;

wherein the dip tube and bucket define a serpentine water flow path for waste water flowing from the inlet to the outlet;

wherein the dip tube is snap-fit twistably releasable from the bucket;

wherein the dip tube and bucket combination is removable from the trap body as a single entity;

wherein the dip tube or the bucket is provided with a first ramp portion, and the other of the dip tube and the bucket is provided with a second ramp portion, wherein the first and second ramp portions are mutually slidably cooperating as the dip tube is twisted relative to the bucket to axially separate the snap-fit engaged dip tube and bucket.

8. The combination as claimed in claim 7, wherein the dip tube includes a ridge formed on an exterior surface, and the bucket includes a complementarily shaped recess on an interior surface, the ridge locating in the recess to engage the dip tube and bucket.

9. The combination as claimed in claim 7, wherein the dip tube includes a filter element.

10. The combination as claimed in claim 7, wherein the dip tube includes a finger grip.

11. The waste water outlet unit as claimed in claim 7, further comprising a removable cover which, when attached, prevents separation of the dip tube and the bucket.

12. The waste water outlet unit as claimed in claim 11, wherein the cover is non-screw threadably attachable to the waste water outlet unit.

13. The waste water outlet unit as claimed in claim 7, wherein the dip tube is extractable from the trap body for cleaning.

14. The waste water outlet unit as claimed in claim 13, further comprising a removable cover which, when attached, prevents separation of the dip tube and the trap body.

15. The waste water outlet unit as claimed in claim 14, wherein the cover is non-screw threadably attachable to the waste water outlet unit.

* * * * *